US009254557B2

(12) United States Patent
Hu

(10) Patent No.: US 9,254,557 B2
(45) Date of Patent: Feb. 9, 2016

(54) RATCHET WRENCH WITH DUSTPROOF STRUCTURE

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 487 days.

(21) Appl. No.: 13/712,102

(22) Filed: Dec. 12, 2012

(65) Prior Publication Data

US 2014/0060259 A1 Mar. 6, 2014

(30) Foreign Application Priority Data

Aug. 28, 2012 (TW) ..... 101131137 A

(51) Int. Cl.
*B25B 13/46* (2006.01)

(52) U.S. Cl.
CPC ..... *B25B 13/46* (2013.01); *B25B 13/463* (2013.01)

(58) Field of Classification Search
CPC B25B 13/463; B25B 23/0035; B25B 13/465; B25B 13/46; B25B 15/04
USPC ..... 81/60, 61, 62, 63.1, 63.2
See application file for complete search history.

(56) References Cited

U.S. PATENT DOCUMENTS

| | | | | |
|---|---|---|---|---|
| 4,211,127 | A * | 7/1980 | D'Oporto et al. | 81/63 |
| 5,916,339 | A * | 6/1999 | Dumont | 81/63.1 |
| 5,921,158 | A * | 7/1999 | Slusar et al. | 81/63 |
| 6,260,448 | B1 * | 7/2001 | Chaconas | 81/63 |
| 7,114,415 | B1 * | 10/2006 | Chiang | 81/63.2 |
| 7,311,019 | B2 | 12/2007 | Arnold et al. | |

* cited by examiner

*Primary Examiner* — Robert Scruggs
(74) *Attorney, Agent, or Firm* — Alan D. Kamrath; Kamrath IP Lawfirm, P.A.

(57) ABSTRACT

A ratchet wrench includes a driving device having first and second sides spaced along a rotating axis. A compartment extends from the first side through the second side. A drive member is received in the compartment and includes an end for driving a tool. A ledge is formed on an inner periphery of an end of the compartment at the second side. A pressing rod extends into the drive member via the end of the compartment at the second side. The pressing rod is movable relative to the drive member along the rotating axis to control engagement with or detachment from the tool. A dustproof ring is mounted between the ledge and the pressing rod. The dustproof ring includes an outer side and an inner side. The outer side presses against an abutment portion of the ledge. The inner side presses against the pressing rod.

12 Claims, 10 Drawing Sheets

RATCHET WRENCH WITH DUSTPROOF STRUCTURE

BACKGROUND OF THE INVENTION

The present invention relates to a ratchet wrench with a dustproof structure and, more particularly, to a ratchet wrench including a dustproof ring mounted between a head and a pressing rod for providing a dustproof effect.

U.S. Pat. No. 7,311,019 discloses a ratchet wrench including a head and a handle connected to the head. The head includes top and bottom ends, with a through cavity formed in the head from the top end to the bottom end. A ratchet gear is disposed in the through cavity. A cover plate is mounted to the bottom end of the head, and a ledge is formed on the top end of the head, preventing the ratchet gear from disengaging from the head. The ratchet gear includes a hole receiving a pressing rod operable to control engagement with or disengagement from a socket or the like. An O-ring is mounted between the top end of the head and the ratchet gear, and another O-ring is mounted between the bottom end of the head and the ratchet gear, preventing or reducing ingress of dirt into a space between the head and the ratchet gear.

However, dirt can enter a gap between the pressing rod and the ratchet gear, impeding movement of the pressing rod relative to the ratchet gear. Thus, the pressing rod can not be operated to control engagement/disengagement of the socket after an amount of dirt is accumulated in the gap between the pressing rod and the ratchet gear, damaging the ratchet wrench.

Thus, a need exists for a ratchet wrench with a novel dustproof structure preventing ingress of dirt into the gap between the pressing rod and the ratchet gear.

BRIEF SUMMARY OF THE INVENTION

The present invention solves this need and other problems in the field of dustproof ratchet wrenches by providing a ratchet wrench including a driving device having first and second sides spaced along a rotating axis. A compartment extends from the first side through the second side. The driving device further includes a drive member received in the compartment and rotatable about the rotating axis. The drive member includes an end, with the end of the drive member adapted to drive a tool. A ledge is formed on an inner periphery of an end of the compartment at the second side. The ledge includes an abutment portion. A pressing rod extends into the drive member via the end of the compartment at the second side. The pressing rod is movable relative to the drive member along the rotating axis to control engagement with or detachment from the tool. A dustproof ring is mounted between the ledge and the pressing rod. The dustproof ring includes an outer side and an inner side surrounded by the outer side and spaced from the outer side in a radial direction perpendicular to the rotating axis. The outer side presses against the abutment portion of the ledge. The inner side presses against the pressing rod.

In preferred forms, the outer side includes an outer periphery pressing against the abutment portion of the ledge. The inner side includes an inner periphery spaced from the outer periphery in the radial direction perpendicular to the rotating axis. The inner periphery includes a lip having an outer surface pressing against the pressing rod. The dustproof ring further includes a flange having an outer diameter perpendicular to the rotating axis. The abutment portion of the ledge is an annular face surrounding the rotating axis and having an inner diameter perpendicular to the rotating axis. The inner diameter of the abutment portion is smaller than the outer diameter of the flange, preventing the dustproof ring from disengaging from the drive member by moving the dustproof ring away from the first side along the rotating axis.

In an example, the lip extends from the inner periphery towards the second side. The lip further has an inner surface located between the outer surface and the inner periphery. A receiving space is defined between the inner periphery and the inner surface of the lip. The receiving space is adapted to receive dirt stopped by the dustproof ring.

In another example, the dustproof ring includes an outer ring and an inner ring. The outer ring includes a first annular portion and a second annular portion, with each of the first and second annular portions including an annular inner face and an annular outer face surrounding the annular inner face. The annular inner face of the first annular portion defines an evasive groove receiving the inner ring. The outer periphery is located on the annular outer face of the second annular portion. The inner periphery is located on the annular inner face of the second annular portion and an annular inner face of the inner ring. The lip is formed on the annular inner face of the inner ring and includes the outer surface pressing against the pressing rod. The lip further has an inner surface located between the outer surface and an annular outer face of the inner ring. A conical section is formed between the annular inner face of the first annular portion and the annular inner face of the second annular portion. A receiving space is defined between the inner surface of the lip and the conical section.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
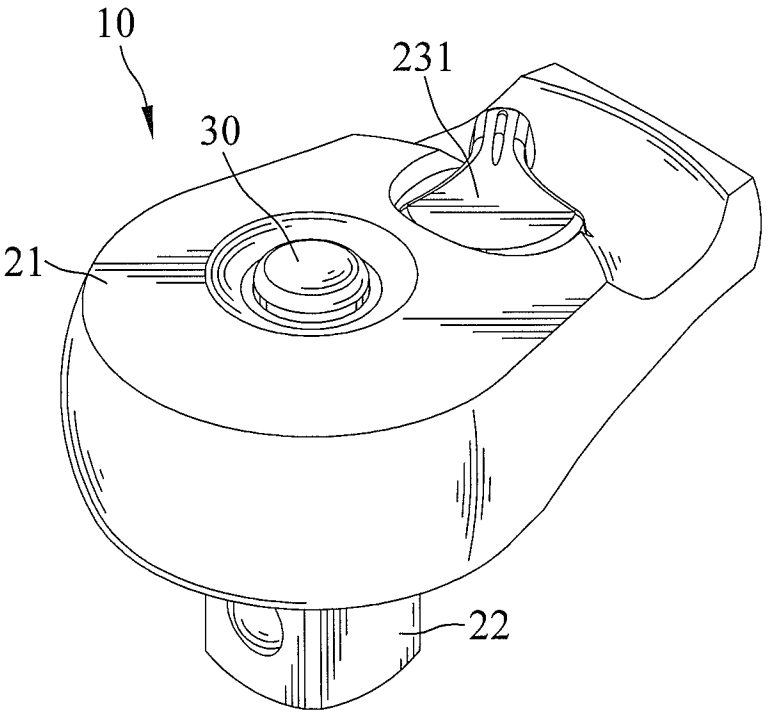
FIG. 1 shows a perspective view of a ratchet wrench with a dustproof structure of a first embodiment according to the present invention.

All figures are drawn for ease of explanation of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "section", "axial", "radial", "annular", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
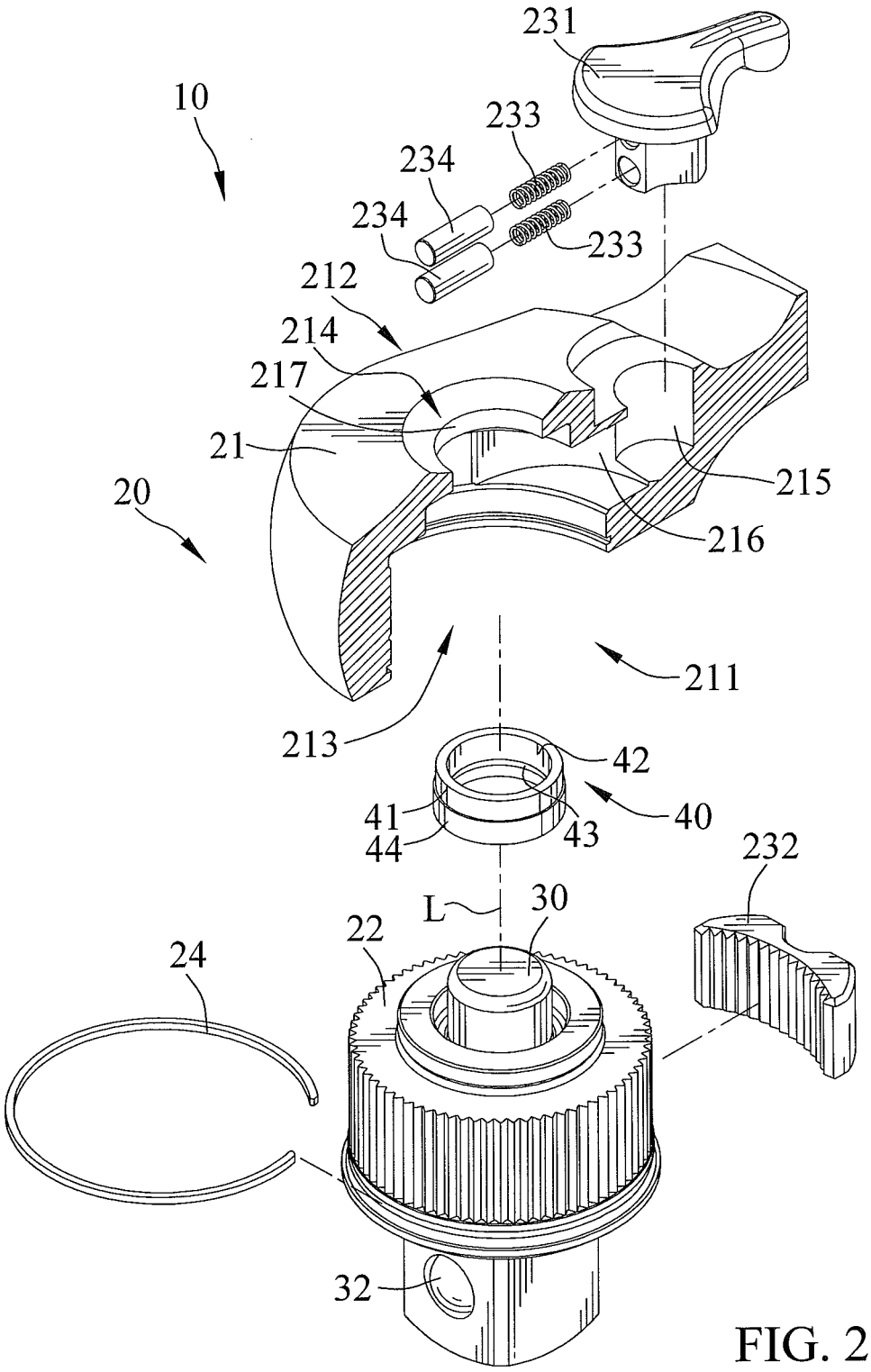
FIG. 2 shows an exploded, perspective view of the ratchet wrench of FIG. 1.
Figure 3:
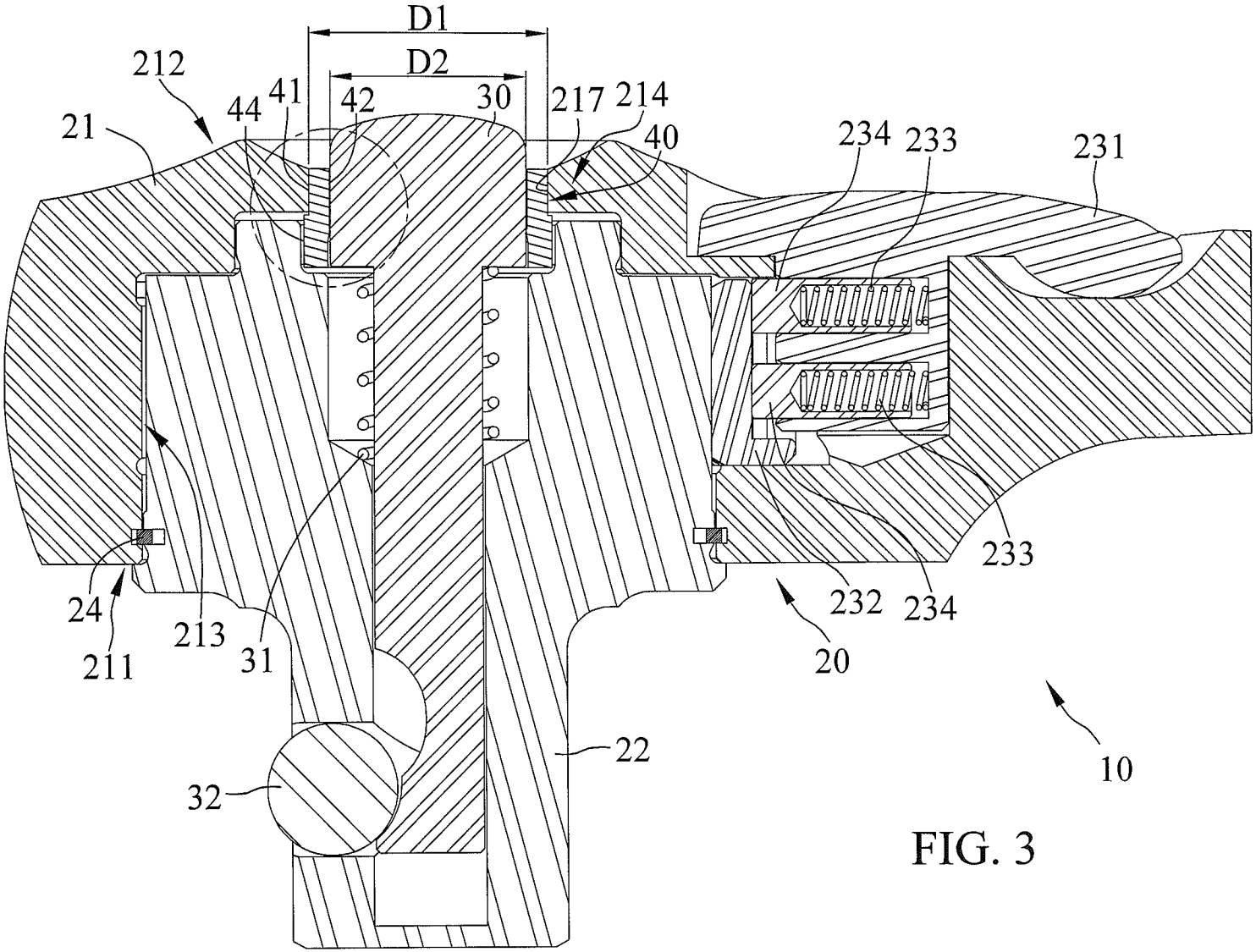
FIG. 3 shows a cross sectional view of the ratchet wrench of FIG. 1.

FIGS. 1-3 are a perspective view, an exploded view, and a cross sectional view of a ratchet wrench with a dustproof structure of a first embodiment according to the present invention, respectively. Ratchet wrench 10 includes a driving device 20, a pressing rod 30, and a dustproof ring 40.

Driving device 20 includes a head 21 including first and second sides 211 and 212 spaced along a rotating axis L. Head 21 further includes a compartment 213 extending from first side 211 through second side 212. Compartment 213 is circular in cross section. A drive member 22 is received in compartment 213 and rotatable about rotating axis L. An end of drive member 22 is adapted to drive a tool, such as a socket. A ledge 214 is formed on an inner periphery of an end of compartment 213 at second side 212. Ledge 214 includes an abutment portion 217 in the form shown as an annular face surrounding rotating axis L. Abutment portion 217 of ledge 214 has a first diameter D1 perpendicular to rotating axis L. Driving device 20 can be manually operated to rotate about rotating axis L. A handle can be removably attached to or integrally formed with head 21.

A control groove 215 is formed in second side 212 of head 21. Head 21 further includes a pawl groove 216 in communication with compartment 213 and control groove 215. Pawl groove 216 is crescent in cross section. A pawl 232 is slideably received in pawl groove 216. A control member 231 is pivotably received in control groove 215. At least one elastic member 233 and at least one pressing member 234 are mounted between control member 231 and pawl 232. Control member 231 is operable to move the pawl 232, controlling an engagement relation between drive member 22 and pawl 232 through the at least one elastic member 233 and the at least one pressing member 234. Thus, head 21 can selectively drive the drive member 22 to rotate in either of a clockwise direction and a counterclockwise direction. In this embodiment, two elastic members 233 and two pressing members 234 are provided to assure reliable engagement between pawl 232 and drive member 22.

A retaining ring 24 is mounted between head 21 and drive member 22 and located at the other end of compartment 213 adjacent to first side 211. Retaining ring 24 abuts head 21 and drive member 22, preventing drive member 22 from disengaging from head 21 via first side 211.

Pressing rod 30 extends into drive member 22 via the end of compartment 213 at second side 212. Pressing rod 30 is movable relative to drive member 22 along rotating axis L to control engagement with or detachment from the tool. An end of pressing rod 30 received in ledge 214 has a second diameter D2 perpendicular to rotating axis L.

Dustproof ring 40 is made of an elastomeric material and mounted between ledge 214 and pressing rod 30. Dustproof ring 40 presses against abutment portion 217 and pressing rod 30, preventing dirt, sand, or other alien objects from entering an interior of head 21 via the end of compartment 213 at second side 212. Thus, driving device 20 can operate smoothly even in a dirty environment.

A spring 31 is mounted between pressing rod 30 and drive member 22. Specifically, spring 31 is mounted around pressing rod 30. A ball 32 is mounted to the other end of pressing rod 30 adjacent to first side 211. Ball 32 is located between pressing rod 30 and drive member 22. A user can press pressing rod 30 to control movement of ball 32, controlling engagement with or detachment from the tool. Spring 31 provides pressing rod 30 with a returning function and biases pressing rod 30 to a position in which drive member 22 is engaged with the tool.

Figure 4:
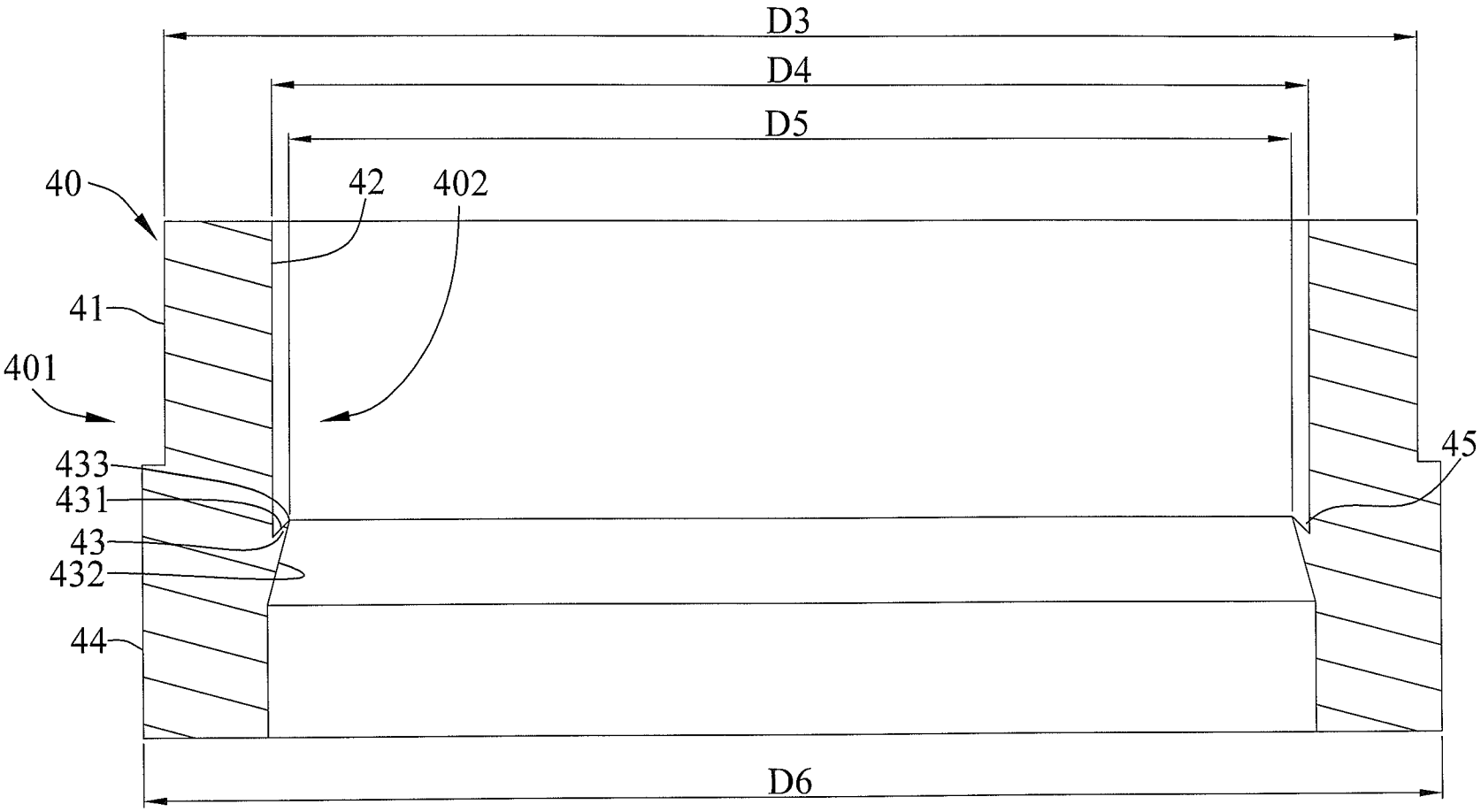
FIG. 4 shows a cross sectional view of a dustproof ring of the ratchet wrench of FIG. 1, with the dustproof ring in an uncompressed state.

FIG. 4 is a cross sectional view of dustproof ring 40 in an uncompressed state. Dustproof ring 40 in the uncompressed state is annular and rectangular in cross section. Dustproof ring 40 includes an outer side 401 and an inner side 402 surrounded by outer side 401 and spaced from outer side 401 in a radial direction perpendicular to rotating axis L, with outer side 401 pressing against abutment portion 217 of ledge 214, with inner side 402 pressing against pressing rod 30. More specifically, outer side 401 includes an outer periphery 41 pressing against abutment portion 217 of ledge 214. Outer periphery 41 of dustproof ring 40 in the uncompressed state has a third diameter D3 perpendicular to rotating axis L. Inner side 402 includes an inner periphery 42 spaced from outer periphery 41 in the radial direction perpendicular to rotating axis L. Inner periphery 42 is adjacent to pressing rod 30. Inner periphery 42 of dustproof ring 40 in the uncompressed state has a fourth diameter D4 perpendicular to rotating axis L.

Furthermore, a lip 43 extends from inner periphery 42 towards second side 212. Lip 43 includes an outer surface 432 pressing against pressing rod 30. Lip 43 further includes an inner surface 431 located between outer surface 432 and inner periphery 42. Lip 43 further includes a tip 433 between inner and outer surfaces 431 and 432. Tip 433 is annular and has a fifth diameter D5 perpendicular to rotating axis L. A receiving space 45 is defined between inner periphery 42 and inner surface 431 of lip 43. Receiving space 45 is adapted to receive dirt stopped by the dustproof ring 40.

Third diameter D3 is larger than first diameter D1, such that dustproof ring 40 is in tight coupling with abutment portion 217 of ledge 214. Fourth diameter D4 is larger than second diameter D2, such that pressing rod 30 can move smoothly relative to drive member 22 along rotating axis L. Fifth diameter D5 is smaller than second diameter D2 such that lip 43 of dustproof ring 40 is in tight coupling with pressing rod 30, preventing dirt from entering an interior of driving device 20 from between pressing rod 30 and dustproof ring 40. Dustproof ring 40 further includes a flange 44 having a sixth diameter D6 perpendicular to rotating axis L. Sixth diameter D6 is larger than third diameter D3, such that flange 44 abuts against and is stopped by ledge 214 when dustproof ring 40 is moved away from first side 211 along rotating axis L, preventing dustproof ring 40 from disengaging from drive member 22 by moving dustproof ring 40 away from first side 211 along rotating axis L.

Figure 5:
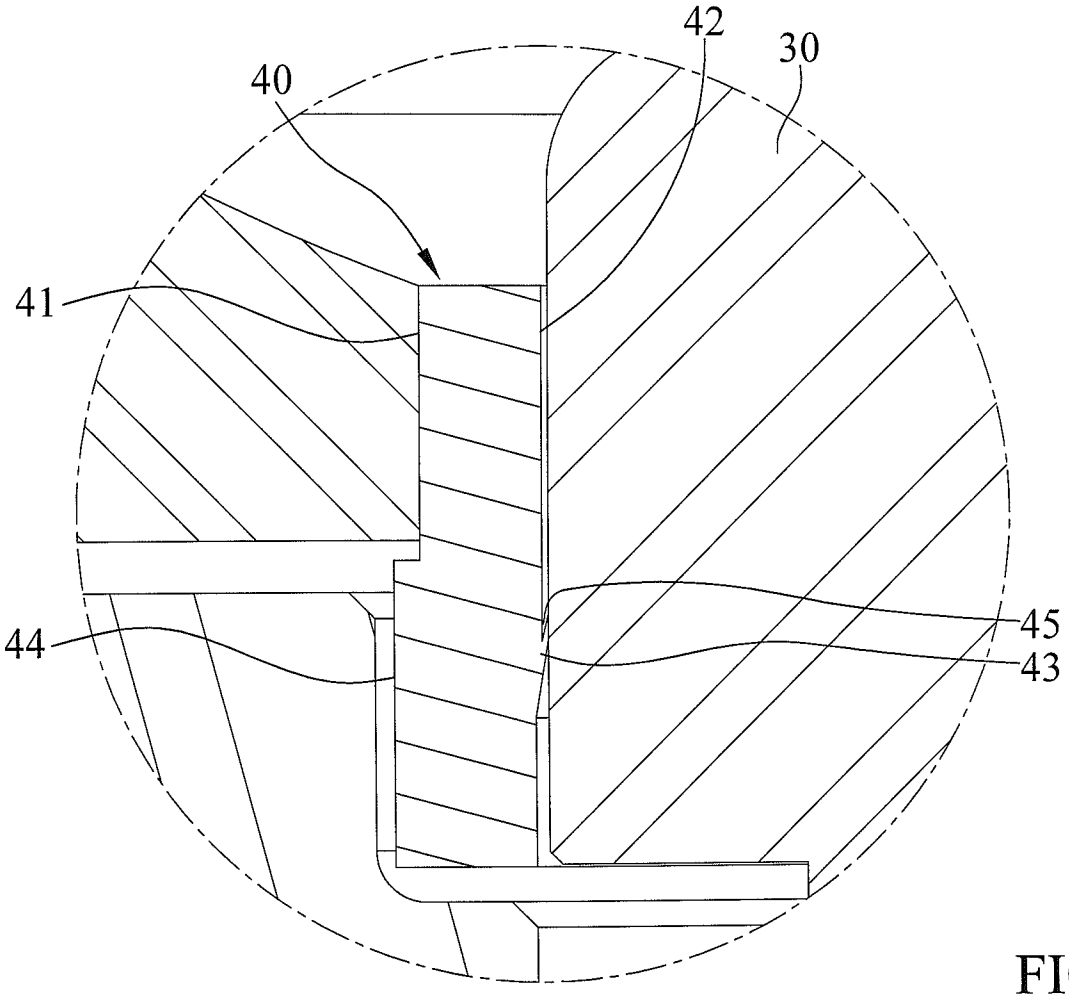
FIG. 5 shows an enlarged view of a circled portion of FIG. 3.

FIG. 5 shows an enlarged view of a circled portion of FIG. 3. Dustproof ring 40 made of elastomeric material is in tight coupling with abutment portion 217 of ledge 214. Furthermore, lip 43 deforms while in tight coupling with pressing rod 30. Specifically, lip 43 bends towards outer side 401, and outer surface 432 presses against pressing rod 30, providing enhanced dustproof effect. When dirt is adhered to pressing rod 30 or enters a gap between pressing rod 30 and inner periphery 42, inner surface 431 of lip 43 scrapes the dirt adhered to pressing rod 30. The dirt falls into and is retained in receiving space 45, preventing the dirt from entering the interior of ratchet wrench 10. Thus, driving device 20 can operate smoothly by preventing dirt from entering the gap between head 21 and drive member 22. Furthermore, dirt is also prevented from entering the gap between pressing rod 30 and drive member 22, allowing the user to easily mount the tool to drive member 22 or detach the tool from drive member 22.

Figure 6:
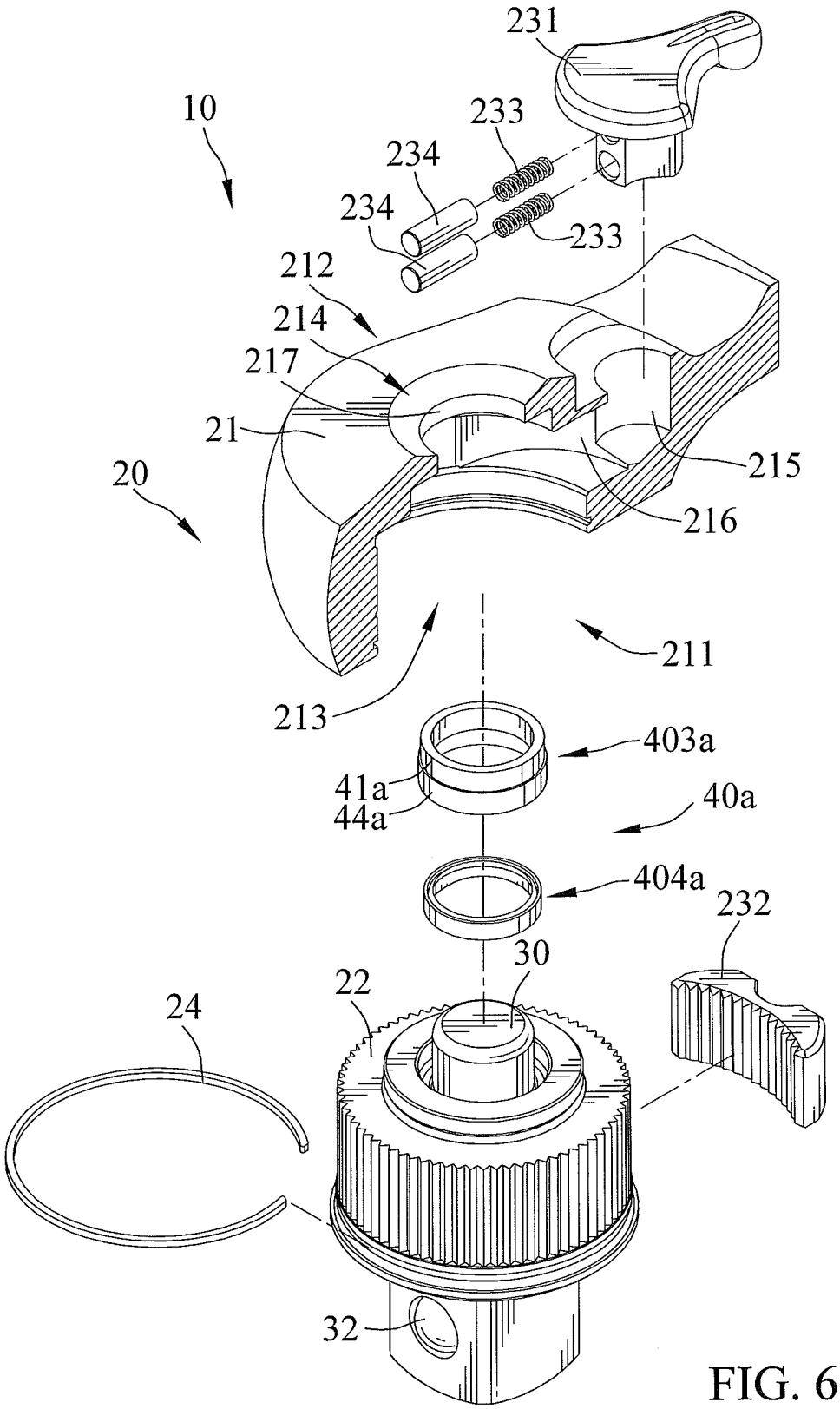
FIG. 6 shows an exploded, perspective view of a ratchet wrench with a dustproof structure of a second embodiment according to the present invention.
Figure 7:
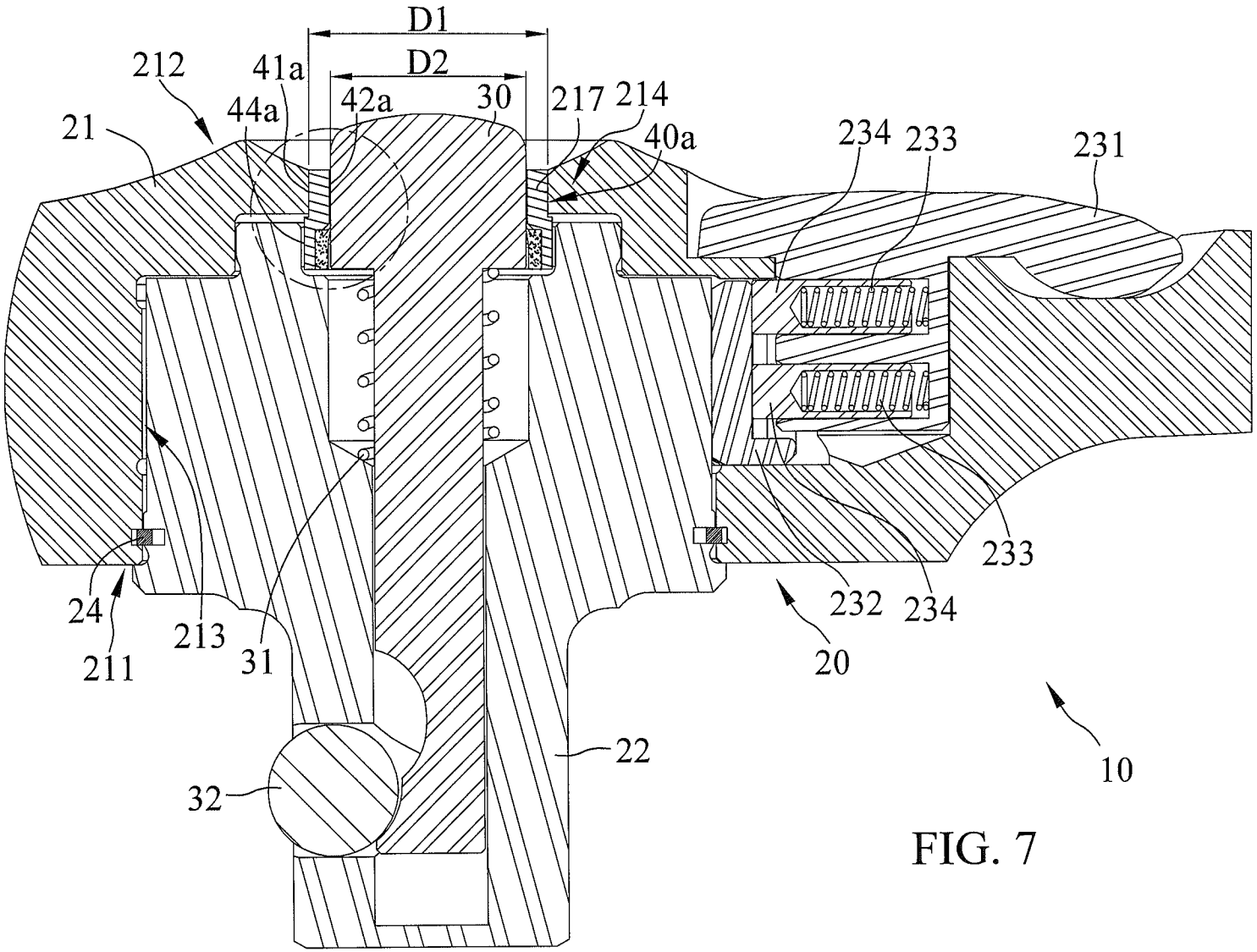
FIG. 7 shows a cross sectional view of the ratchet wrench of FIG. 6.
Figure 8:
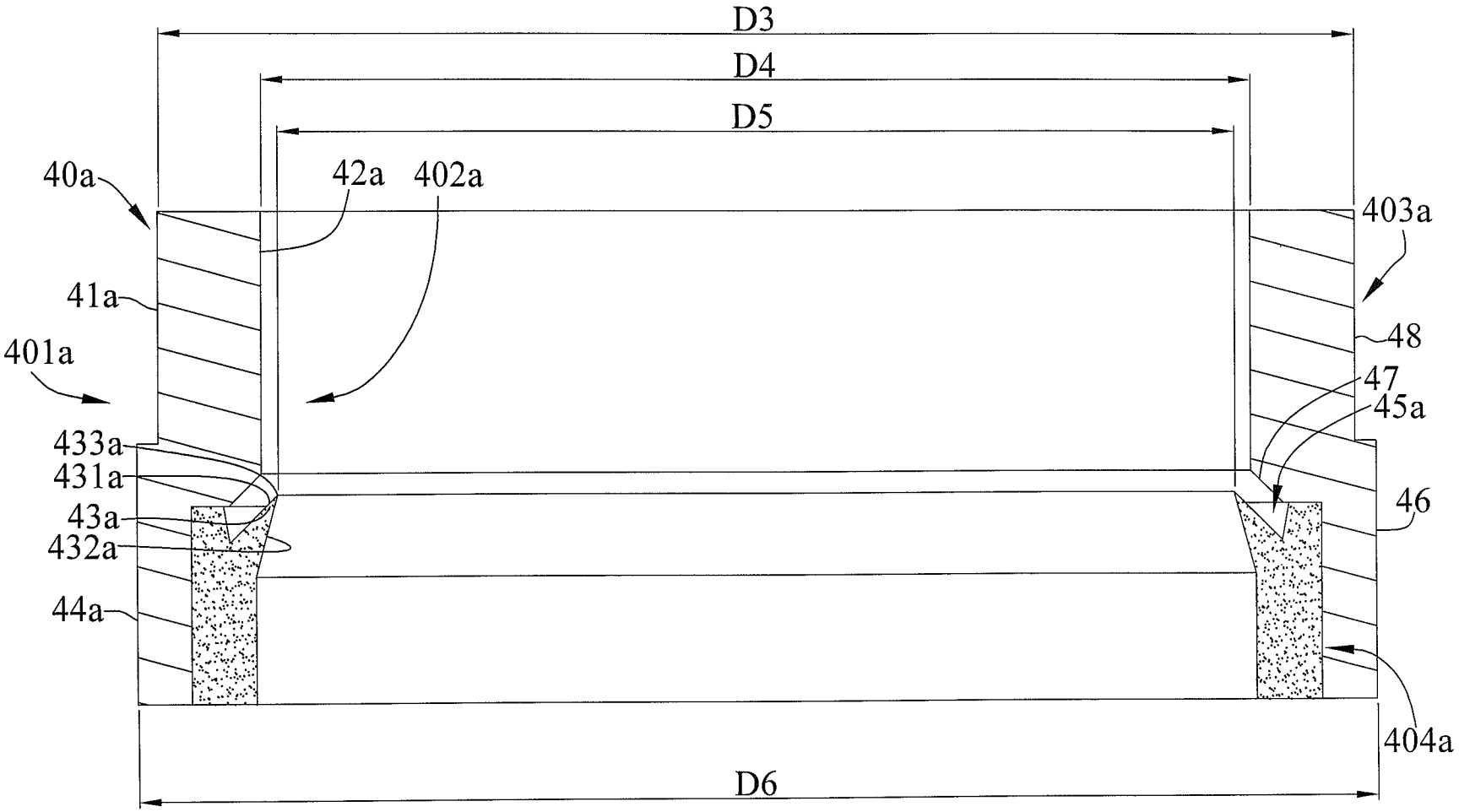
FIG. 8 shows a cross sectional view of a dustproof ring of the ratchet wrench of FIG. 7, with the dustproof ring in an uncompressed state.
Figure 9:
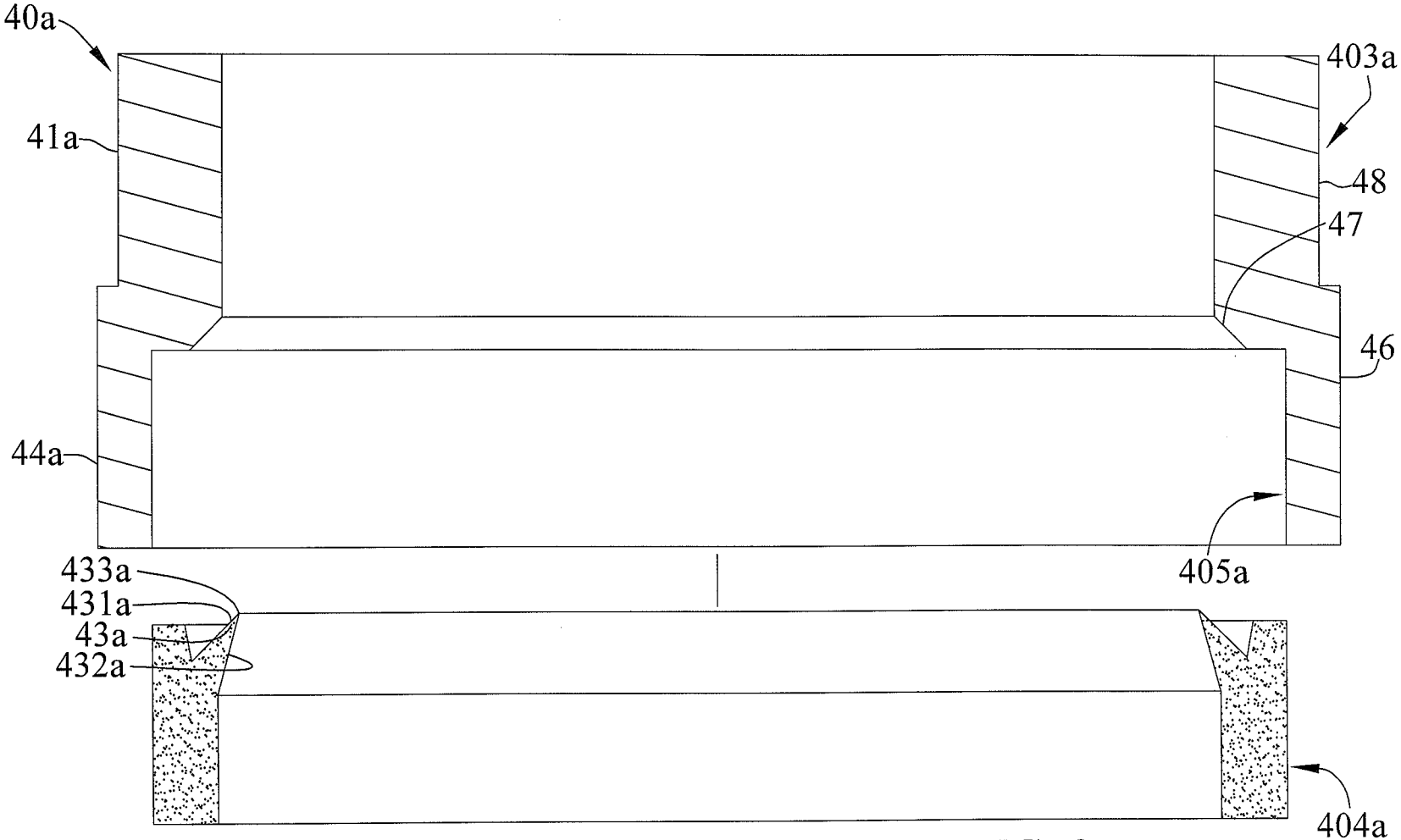
FIG. 9 is an exploded, cross sectional view illustrating assembly of the dustproof ring of FIG. 8.

FIGS. 6 and 7 are an exploded view and a cross sectional view of a ratchet wrench with a dustproof structure of a second embodiment according to the present invention, respectively. FIG. 8 is a cross sectional view of the dustproof ring in an uncompressed state. FIG. 9 is an exploded, cross sectional view illustrating assembly of the dustproof ring of FIG. 8. Similar to the first embodiment, dustproof ring 40*a* includes an outer side 401*a* having an outer periphery 41*a* pressing against abutment portion 217 and an inner side 402*a* having an inner periphery 42*a* pressing against pressing rod 30. In this embodiment, dustproof ring 40*a* includes an outer ring 403*a* and an inner ring 404*a*. Each of outer and inner rings 403*a* and 404*a* is made of an elastomeric material, is annular, and is rectangular in cross section.

Specifically, outer ring 403*a* includes a first annular portion 46 and a second annular portion 48, with each of first and second annular portions 46 and 48 having an annular inner face and an annular outer face surrounding the annular inner face. The annular inner face of first annular portion 46 defines an evasive groove 405*a* receiving inner ring 404*a*. Outer periphery 41*a* is located on the annular outer face of second annular portion 48. Inner periphery 42*a* is located on the annular inner face of second annular portion 48 and an annular inner face of inner ring 404*a*. A lip 43*a* is formed on the annular inner face of inner ring 404*a* and includes an outer surface 432*a* pressing against pressing rod 30. Lip 43*a* further has an inner surface 431*a* located between outer surface 432*a* and an annular outer face of inner ring 404*a*. A conical section 47 is formed between the annular inner face of first annular portion 46 and the annular inner face of second annular portion 48. A receiving space 45*a* is defined between inner surface 431*a* of lip 43*a* and conical section 47. Receiving space 45*a* is adapted to receive dirt stopped by dustproof ring 40*a*.

Outer periphery 41*a* of dustproof ring 40*a* in the uncompressed state has a third diameter D3 perpendicular to rotating axis L. Inner periphery 42*a* of dustproof ring 40*a* in the uncompressed state has a fourth diameter D4 perpendicular to rotating axis L. Lip 43*a* further includes a tip 433*a* between inner and outer surfaces 431*a* and 432*a*. Tip 433*a* is annular and has a fifth diameter D5 perpendicular to rotating axis L. Third diameter D3 is larger than first diameter D1, such that outer ring 403*a* of dustproof ring 40*a* is in tight coupling with abutment portion 217 of ledge 214. Fourth diameter D4 is larger than second diameter D2, such that pressing rod 30 can move smoothly relative to drive member 22 along rotating axis L. Fifth diameter D5 is smaller than second diameter D2, such that lip 43*a* of dustproof ring 40*a* is in tight coupling with pressing rod 30, preventing dirt from entering an interior of driving device 20 from between pressing rod 30 and dustproof ring 40*a*. Outer ring 403*a* further includes a flange 44*a* having a sixth diameter D6 perpendicular to rotating axis L. Sixth diameter D6 is larger than third diameter D3, such that flange 44*a* abuts against and is stopped by ledge 214 when dustproof ring 40 is moved away from first side 211 along rotating axis L, preventing dustproof ring 40*a* from disengaging from drive member 22 by moving dustproof ring 40*a* away from first side 211 along rotating axis L.

Figure 10:
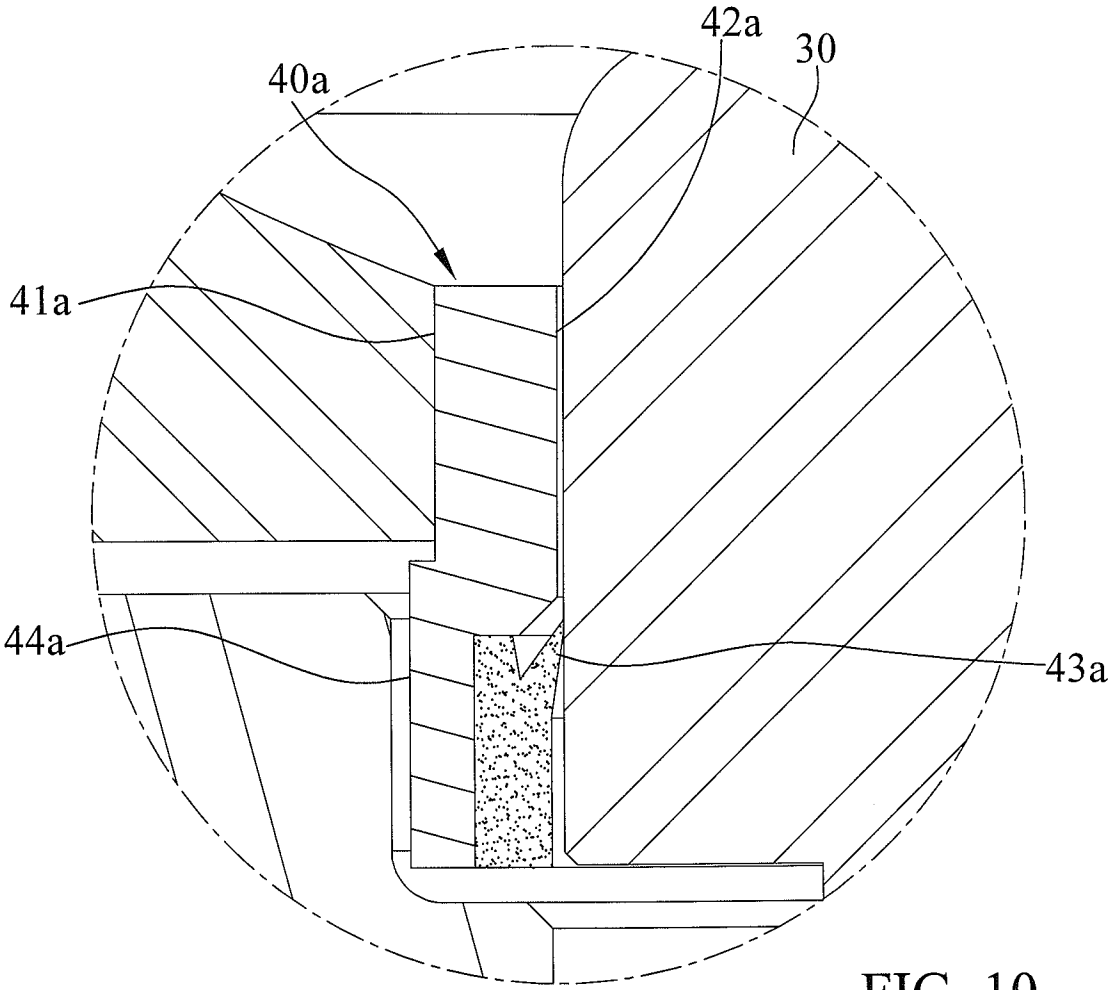
FIG. 10 shows an enlarged view of a circled portion of FIG. 7.

FIG. 10 is an enlarged view of a circled portion of FIG. 7. Dustproof ring 40*a* made of an elastomeric material is in tight coupling with abutment portion 217 of ledge 214. Furthermore, lip 43*a* deforms while in tight coupling with pressing rod 30. Specifically, lip 43*a* bends towards outer side 401*a*, and outer surface 432*a* presses against pressing rod 30, providing enhanced dustproof effect. When dirt is adhered to pressing rod 30 or enters a gap between pressing rod 30 and inner periphery 42*a*, inner surface 431*a* of lip 43*a* scrapes the dirt adhered to pressing rod 30. The dirt falls into and is retained in receiving space 45*a*, preventing the dirt from entering the interior of ratchet wrench 10. Thus, driving device 20 can operate smoothly by preventing dirt from entering the gap between head 21 and drive member 22. Furthermore, dirt is also prevented from entering the gap between pressing rod 30 and drive member 22, allowing the user to easily mount the tool to drive member 22 or detach the tool from drive member 22.

In conclusion, ratchet wrench 10 according to the present invention provides the following advantages:

1. Dustproof ring 40, 40*a* mounted between driving device 20 and pressing rod 30 prevents dirt from entering the gap between head 21 and drive member 22, assuring smooth operation of driving device 20. Furthermore, dirt can not enter the gap between pressing rod 30 and drive member 22, allowing the user to easily mount the tool to or detach the tool from the drive member 22.

2. Dustproof ring 40, 40*a* made of elastomeric material deforms to an extent responsive to external conditions, such that dustproof ring 40, 40*a* can be in tight coupling with abutment portion 217 of ledge 214. Furthermore, lip 43, 43*a* deforms while in tight coupling with pressing rod 30. Lip 43, 43*a* bends towards outer side 401, 401*a*, and outer surface 432, 432*a* presses against pressing rod 30, providing enhanced dustproof effect. Inner surface 431, 431*a* of lip 43, 43*a* scrapes the dirt adhered to pressing rod 30 or entering the gap between pressing rod 30 and inner periphery 42, 42*a*, preventing the dirt from entering the interior of ratchet wrench 10.

3. Dustproof ring 40, 40*a* provides receiving space 45, 45*a*. The dirt falls into receiving space 45, 45*a* along inner surface 432, 432*a* and is retained in receiving space 45, 45*a*, effectively preventing the dirt from entering the interior of ratchet wrench 10.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising:

a driving device including first and second sides spaced along a rotating axis, with a compartment extending from the first side through the second side, with the driving device further including a drive member received in the compartment and rotatable about the rotating axis, with the drive member including an end, with the end of the drive member adapted to drive a tool, with a ledge formed on an inner periphery of an end of the compartment at the second side, with the ledge including an abutment portion;

a pressing rod extending into the drive member via the end of the compartment at the second side, with the pressing rod movable relative to the drive member along the rotating axis to control engagement with or detachment from the tool; and a dustproof ring mounted between the ledge and the pressing rod, with the dustproof ring including an outer side and an inner side surrounded by the outer side and spaced from the outer side in a radial direction perpendicular to the rotating axis, with the outer side pressing against the abutment portion of the ledge, with the inner side pressing against the pressing rod, with the dustproof ring including an outer ring and an inner ring, with the outer ring including a first annular portion and a second annular portion, with each of the first and second annular portions including an annular inner face and an annular outer face surrounding the annular inner face, with the annular inner face of the first annular portion defining an evasive groove receiving the inner ring, with the outer periphery located on the annular outer face of the second annular portion, with the inner periphery located on the annular inner face of the second annular portion and an annular inner face of the inner ring, with a lip formed on the annular inner face of the inner ring and including the outer surface pressing against the pressing rod.

2. The ratchet wrench as claimed in claim 1, with each of the outer and inner rings being annular and rectangular in cross section, with the lip defining a receiving space between the outer and inner rings, with the receiving space adapted to receive dirt stopped by the dustproof ring.

3. The ratchet wrench as claimed in claim 2, with the outer side including an outer periphery pressing against the abutment portion of the ledge, with the inner side including an inner periphery spaced from the outer periphery in the radial direction perpendicular to the rotating axis, with the inner periphery including a lip having an outer surface pressing against the pressing rod.

4. The ratchet wrench as claimed in claim 1, with the outer side including an outer periphery pressing against the abutment portion of the ledge, with the inner side including an inner periphery spaced from the outer periphery in the radial direction perpendicular to the rotating axis, with the inner periphery including a lip having an outer surface pressing against the pressing rod.

5. The ratchet wrench as claimed in claim 4, with the lip further having an inner surface located between the outer surface and an annular outer face of the inner ring, with a conical section formed between the annular inner face of the first annular portion and the annular inner face of the second annular portion, with a receiving space defined between the inner surface of the lip and the conical section, with the receiving space adapted to receive dirt stopped by the dustproof ring.

6. The ratchet wrench as claimed in claim 5, with the abutment portion of the ledge being an annular face surrounding the rotating axis and having a first diameter perpendicular to the rotating axis, with an end of the pressing rod received in the ledge and having a second diameter perpendicular to the rotating axis, with the outer periphery of the dustproof ring in an uncompressed state having a third diameter perpendicular to the rotating axis, with the inner periphery of the dustproof ring in the uncompressed state having a fourth diameter perpendicular to the rotating axis, with the lip further including a tip between the inner and outer surfaces, with the tip being annular and having a fifth diameter perpendicular to the rotating axis, with the third diameter larger than, the first diameter, with the fourth diameter larger than the second diameter, with the fifth diameter smaller than the second diameter.

7. The ratchet wrench as claimed in claim 6, with the outer ring including a flange having a sixth diameter perpendicular to the rotating axis, with the sixth diameter larger than the third diameter.

8. A ratchet wrench comprising:

a driving device including first and second sides spaced along a rotating axis, with a compartment extending from the first side through the second side, with the driving device further including a drive member received in the compartment and rotatable about the rotating axis, with the drive member including an end, with the end of the drive member adapted to drive a tool with the compartment including a first face abutting with a second face of the drive member opposite to the end of the drive member, with a ledge formed on an inner periphery of an end of the compartment at the second side axially spaced from the first face of the compartment opposite to the end of the drive member, with the ledge including an abutment portion of an annular shape, with the drive member including an annular protrusion extending axially from the second face and opposite to the end of the drive member past the first face;

a pressing rod extending into the drive member via the abutment portion and the end of the compartment at the second side, with the pressing rod movable relative to the drive member along the rotating axis to control engagement with or detachment from the tool; and a dustproof ring mounted between the ledge and the pressing rod, with the dustproof ring including an outer side and an inner side surrounded by the outer side and spaced from the outer side in a radial direction perpendicular to the rotating axis, with the outer side pressing against the abutment portion of the ledge, with the inner side pressing against the pressing rod, with the dustproof ring including a flange having an outer diameter perpendicular to the rotating axis, with the abutment portion of the ledge being an annular face surrounding the rotating axis and having an inner diameter perpendicular to the rotating axis, with the inner diameter of the abutment portion smaller than the outer diameter of the flange, preventing the dustproof ring from disengaging from the drive member by moving the dustproof ring away from the first side along the rotating axis.

9. The ratchet wrench as claimed in claim 8, with the outer side including an outer periphery pressing against the abutment portion of the ledge, with the inner side including an inner periphery spaced from the outer periphery in the radial direction perpendicular to the rotating axis, with the inner periphery including a lip having an outer surface pressing against the pressing rod.

10. The ratchet wrench as claimed in claim 9, with the lip extending from the inner periphery towards the second side, with the lip further having an inner surface located between the outer surface and the inner periphery, with a receiving space defined between the inner periphery and the inner surface of the lip, with the receiving space adapted to receive dirt stopped by the dustproof ring.

11. The ratchet wrench as claimed in claim 9, with the abutment portion of the ledge being an annular face surrounding the rotating axis and having a first diameter perpendicular to the rotating axis, with an end of the pressing rod received in the ledge and having a second diameter perpendicular to the rotating axis, with the outer periphery of the dustproof ring in an uncompressed state having a third diameter perpendicular to the rotating axis, with the inner periphery of the dustproof ring in the uncompressed state having a fourth diameter perpendicular to the rotating axis, with the lip further including a tip between the inner and outer surfaces, with the tip being annular and having a fifth diameter perpendicular to the rotating axis, with the third diameter larger than the first diameter, with the fourth diameter larger than the second diameter, with the fifth diameter smaller than the second diameter.

12. The ratchet wrench as claimed in claim 8, with the driving device including a head having the first and second sides, with a control groove formed in the second side of the head, with the head including a pawl groove in communication with the compartment and the control groove, with a pawl slideably received in the pawl groove, with a control member pivotably received in the control groove, with an elastic member and a pressing member mounted between the control member and the pawl, with the control member operable to move the pawl to engage with the drive member, allowing the head to selectively drive the drive member in either of a clockwise direction and a counterclockwise direction.

* * * * *